US009378905B2

(12) United States Patent
Sims et al.

(10) Patent No.: US 9,378,905 B2
(45) Date of Patent: Jun. 28, 2016

(54) INTER-POLE DRIVE BAR USABLE WITH SWITCH APPARATUS HAVING MULTIPLE POLES

(71) Applicant: EATON CORPORATION, Cleveland, OH (US)

(72) Inventors: Daniel Garett Sims, Newberry, SC (US); Christopher Michael Diroll, Pittsburgh, PA (US); Jon Christopher Beaver, Asheville, NC (US)

(73) Assignee: EATON CORPORATION, Cleveland, OH (US)

( * ) Notice: Subject to any disclaimer, the term of this patent is extended or adjusted under 35 U.S.C. 154(b) by 233 days.

(21) Appl. No.: 14/013,141

(22) Filed: Aug. 29, 2013

(65) Prior Publication Data

US 2015/0060246 A1 Mar. 5, 2015

(51) Int. Cl.

| | |
|---|---|
| ***H01H 33/42*** | (2006.01) |
| ***H01H 9/26*** | (2006.01) |
| *H01H 33/52* | (2006.01) |
| *H01H 71/10* | (2006.01) |

(52) U.S. Cl.

CPC ..... *H01H 9/26* (2013.01); *H01H 33/52* (2013.01); *H01H 71/1027* (2013.01); *H01H 2009/265* (2013.01)

(58) Field of Classification Search

CPC ..... H01H 13/702; H01H 2003/323; H01H 33/42; H01H 33/666; H01H 9/563

USPC ..... 200/19.21, 19.26–27, 49, 307, 329, 200/401; 345/167–171, 189; 174/161 R

See application file for complete search history.

(56) References Cited

U.S. PATENT DOCUMENTS 6,313,424 B1 * 11/2001 Bachofen ..... 218/6
8,242,399 B2 * 8/2012 van Dijk et al. ..... 200/400

* cited by examiner

*Primary Examiner* — Renee Luebke
*Assistant Examiner* — Ahmed Saeed
(74) *Attorney, Agent, or Firm* — Eckert Seamans Cherin & Mellott, LLC; Brij K. Agarwal; Philip E. Levy

(57) ABSTRACT

An inter-pole drive bar in accordance with the disclosed and claimed concept is usable to extend among a plurality of poles of an improved switch apparatus and to cause the plurality of poles to be together moved between a CLOSED position and an OPEN position. The inter-pole drive bar is elongated and has a plurality of connection points that are connectable with the poles and further includes a number of features that avoid engagement or other interference between the inter-pole drive bar and the various structures of the switch apparatus. The inter-pole drive bar includes an elongated linkage element whose movement between the CLOSED and OPEN positions of the switch apparatus are primarily translation of the linkage element in a direction generally parallel with its longitudinal extent and translation of the linkage element in a direction generally perpendicular to its longitudinal extent.

15 Claims, 7 Drawing Sheets

INTER-POLE DRIVE BAR USABLE WITH SWITCH APPARATUS HAVING MULTIPLE POLES

BACKGROUND

1. Field

The disclosed and claimed concept relates generally to electrical interruption apparatus and, more particularly, to an inter-pole drive bar that is usable with load interruption switchgear and that enables a plurality of poles to be together moved between a CLOSED position and an OPEN position.

2. Related Art

Numerous types of electrical interruption apparatus are generally known. Electrical interruption devices include circuit breakers, load interrupters, and other well known devices. As is generally understood, circuit breakers typically include a set of loaded springs and a trip mechanism, and in certain predefined circumstances the trip mechanism releases the mechanical potential stored in the loaded springs to cause a set of electrical contacts to be moved from a CLOSED position to an OPEN position. Certain types of load interruption switchgear include a pivotable blade for each pole that is manually or otherwise movable between a CLOSED position and an OPEN position. While such load interruption switchgear has been generally effective for its intended purposes, it has not been without limitation.

For example, load interruption switchgear having movable conductive blades typically must have some type of mechanism to move the blades between the CLOSED and OPEN positions, and such movement in the case of multiple-pole equipment is preferably done among all of the poles simultaneously. Previously known blade-type load interruption switchgear typically has thus had its multiple poles arranged side-by-side and has employed a rotatable crank with drive links extending between the crank and each conductive blade to move the conductive blades of the various poles between the CLOSED and OPEN positions. The side-by-side arrangement of the plurality of poles has caused such load interruption switchgear to be relatively wide and to thereby occupy a meaningful amount of the accessible floor space in a facility. It thus would be desirable to provide an improved solution.

SUMMARY

Accordingly, an inter-pole drive bar in accordance with the disclosed and claimed concept is usable to extend among a plurality of poles of an improved switch apparatus and to cause the plurality of poles to be together moved between a CLOSED position and an OPEN position. The inter-pole drive bar is elongated and has a plurality of connection points that are connectable with the poles and further includes a number of features that avoid engagement or other interference between the inter-pole drive bar and the various structures of the switch apparatus. The inter-pole drive bar includes an elongated linkage element whose movement between the CLOSED and OPEN positions of the switch apparatus are primarily translation of the linkage element in a direction generally parallel with its longitudinal extent and translation of the linkage element in a direction generally perpendicular to its longitudinal extent.

Accordingly, as aspect of the disclosed and claimed concept is to provide an improved inter-pole drive bar that is connectable among a plurality of poles of a switch apparatus and that includes various features that avoid engagement or other interference between the drive bar and the poles of the switch apparatus.

Another aspect of the disclosed and claimed concept is to provide an improved switch apparatus that employs the inter-pole drive bar.

As such, the disclosed and claimed concept can be said to be generally directed toward a drive bar that is structured to extend among a plurality of poles of a switch apparatus, each pole having a conductive blade that is pivotable between a CLOSED position and an OPEN position, the drive bar being structured to enable the plurality of poles to be together moved between the CLOSED and OPEN positions. The drive bar can be generally stated as including an elongated linkage element having a plurality of connection points that are spaced apart from one another along at least a portion of the length of the linkage element, each connection point being structured to be connected with a corresponding pole of the plurality of poles, and the linkage element having formed therein a number of features, at least some of the number of features being structured to enable the linkage element to avoid engagement with a number of structures of the switch apparatus, the number of features comprising at least a first indentation formed in the linkage element.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION

An improved drive bar 4 is depicted generally in FIGS. 1A, 1B, 3, and 4. The drive bar 4 is employable in a switch apparatus 6, such as is depicted generally in FIG. 2. The switch apparatus 6 includes a plurality of poles 8A, 8B, and 8C with which the drive bar 4 is cooperable. More particularly, the drive bar 4 is mechanically connected with each of the poles 8A, 8B, and 8C and is operable to together move the poles 8A, 8B, and 8C between a CLOSED position, such as is depicted generally in FIGS. 5A-5C, and an OPEN position, such as is depicted generally in FIGS. 6A-6C. The drive bar 4 can thus be referred to generally as being an inter-pole drive bar since it extends among the poles 8A, 8B, and 8C and causes them to operate substantially simultaneously in movement between the CLOSED and OPEN positions.

Figure 1A:
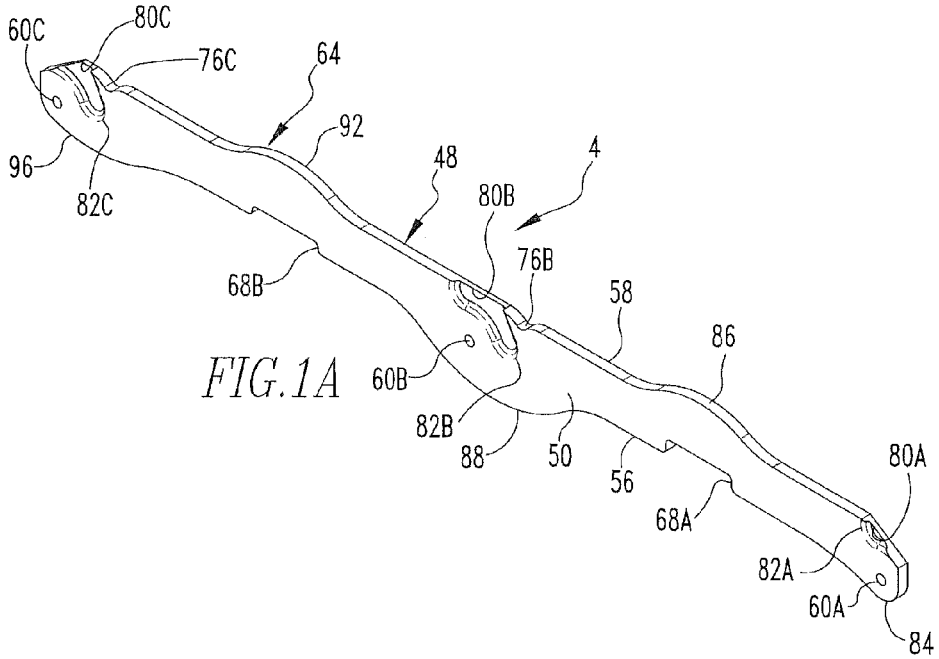
FIG. 1A is a perspective view of an improved drive bar in accordance with the disclosed and claimed concept.
Figure 1B:
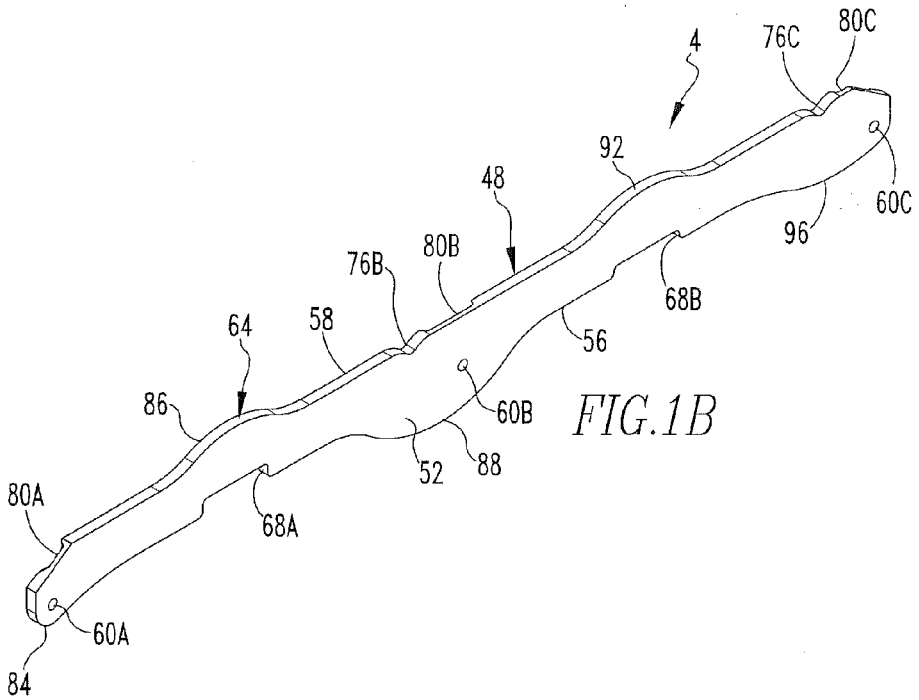
FIG. 1B is another perspective view of the drive bar of FIG. 1A.
Figure 2:
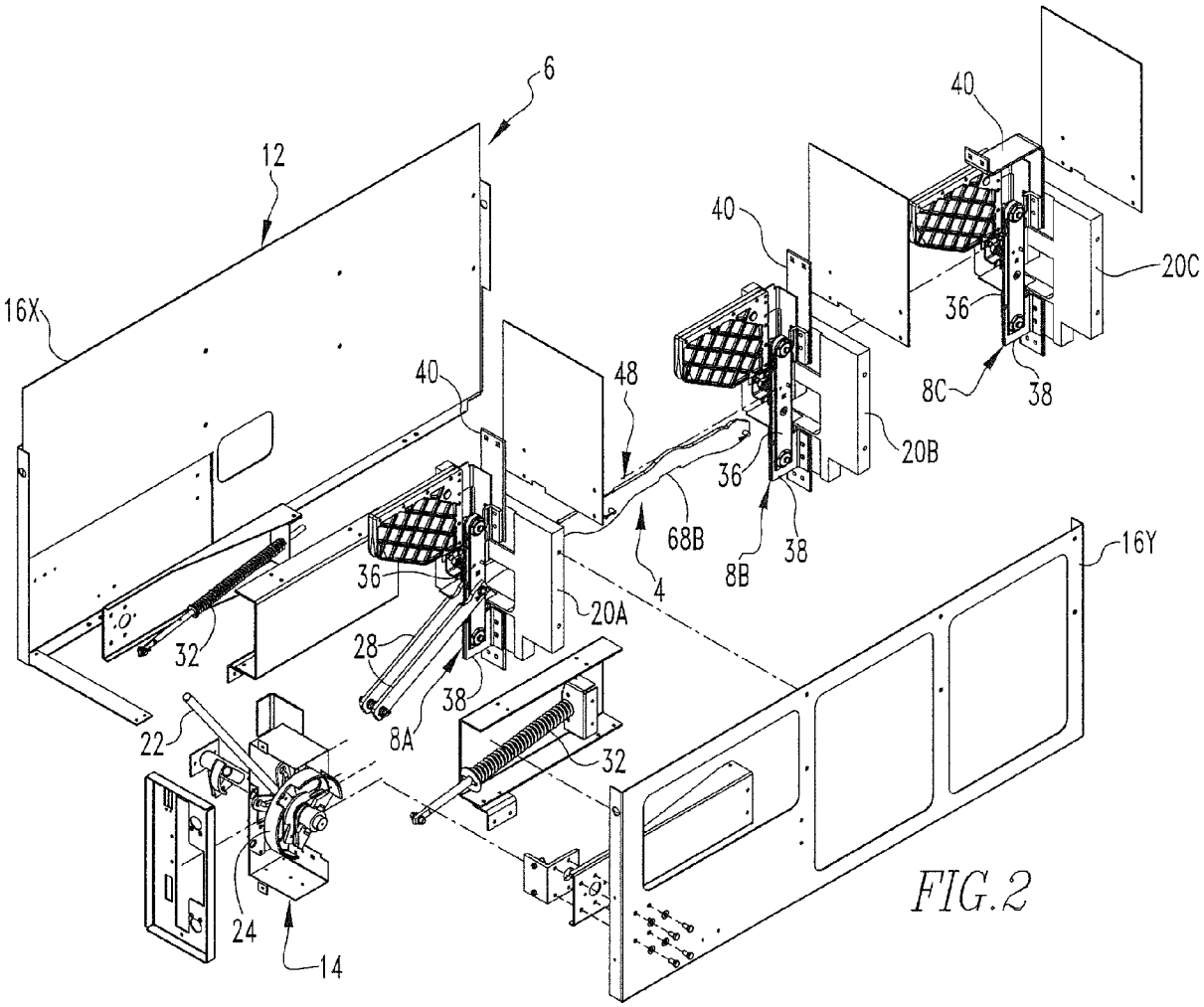
FIG. 2 is an exploded view of an improved switch apparatus that employs the drive bar of FIGS. 1A and 1B.
Figure 3:
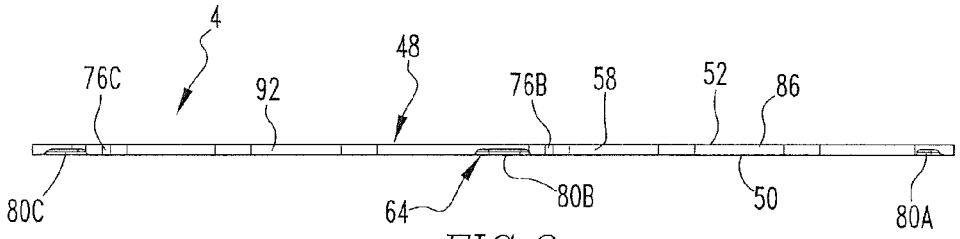
FIG. 3 is a top plan view of the drive bar of FIG. 1A.

As can be seen in FIG. 2, the switch apparatus 6 further includes a support apparatus 12 upon which the poles 8A, 8B, and 8C are mounted and an operating mechanism 14 that is connectable with the drive bar 4 and that causes the drive bar 4 to move the poles 8A, 8B, and 8C between the CLOSED and OPEN positions. In so doing, the drive bar 4 can be said to move between a first position which corresponds with the CLOSED position of the switch apparatus 6 and a second position which corresponds with the OPEN position of the switch apparatus 6. The support apparatus 12 can be said to include a pair of side supports 16X and 16Y and to further include a set of three insulative supports 20A, 20B and 20C that are mountable to the side supports 16X and 16Y and upon which the poles 8A, 8B, and 8C, respectively, are mounted.

The operating mechanism 14 can be said to include an operating handle 22, a pivotable crank 24, a set of main drive links 28, and a set of springs 32. The operating handle 22 is situated on the crank 24 and is structured to be manually grasped by a technician in order to move the switch apparatus 6 between its CLOSED and OPEN positions. Such movement of the operating handle 22 causes the crank 24 be moved between a first configuration, such as is depicted generally in FIGS. 5A-5B, and a second configuration, such as is depicted generally in FIGS. 6A-6B. The first configuration of the crank 24 corresponds with the CLOSED position of the switch apparatus 6, and the second configuration of the crank 24 corresponds with the OPEN position of the switch apparatus 6. The main drive links 28 are connected at one end with the crank 24 and are connected at the other end with the pole 8A and the drive bar 4, as will be set forth in greater detail below. The main drive links 28 communicate the movement of the operating handle 22 to the pole 8A and to the drive bar 4. As will be set forth in greater detail below, the drive bar 4 communicates such movement from the pole 8A to the poles 8B and 8C.

The springs 32 extend between the crank 24 and the support apparatus 12 and are of an over-centering configuration such that the elastic forces in the springs 32 cause the poles 8A, 8B, and 8C to arrive at the CLOSED and OPEN positions with more force than would be provided merely from the movement force applied to the operating handle 22. Such spring force is desirable to increase the speed of movement of the poles 8A, 8B, and 8C toward the CLOSED and OPEN positions and to ensure rapid electrical connection and disconnection between the separable parts of the poles 8A, 8B, and 8C.

Figure 5A:
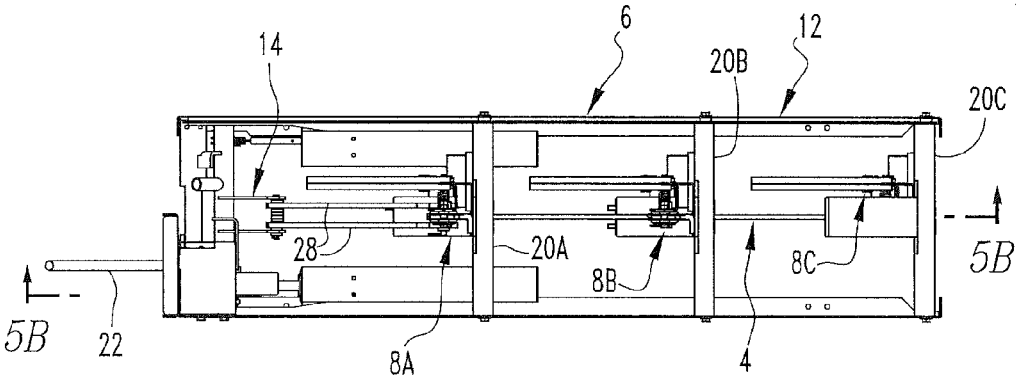
FIG. 5A is a top plan view of the switch apparatus in a CLOSED position.
Figure 5B:
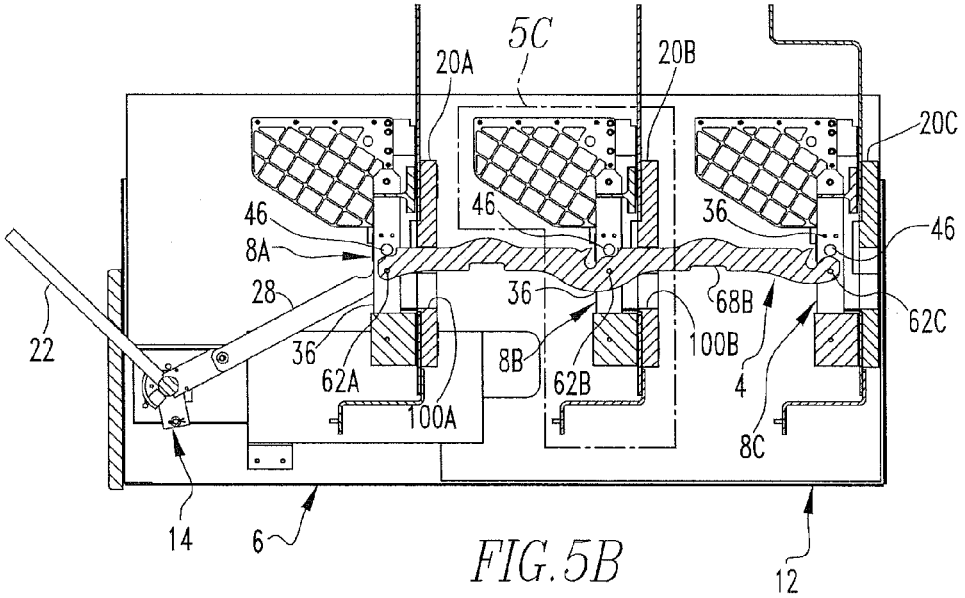
FIG. 5B is a sectional view as taken along line 5B-5B of FIG. 5A.
Figure 5C:
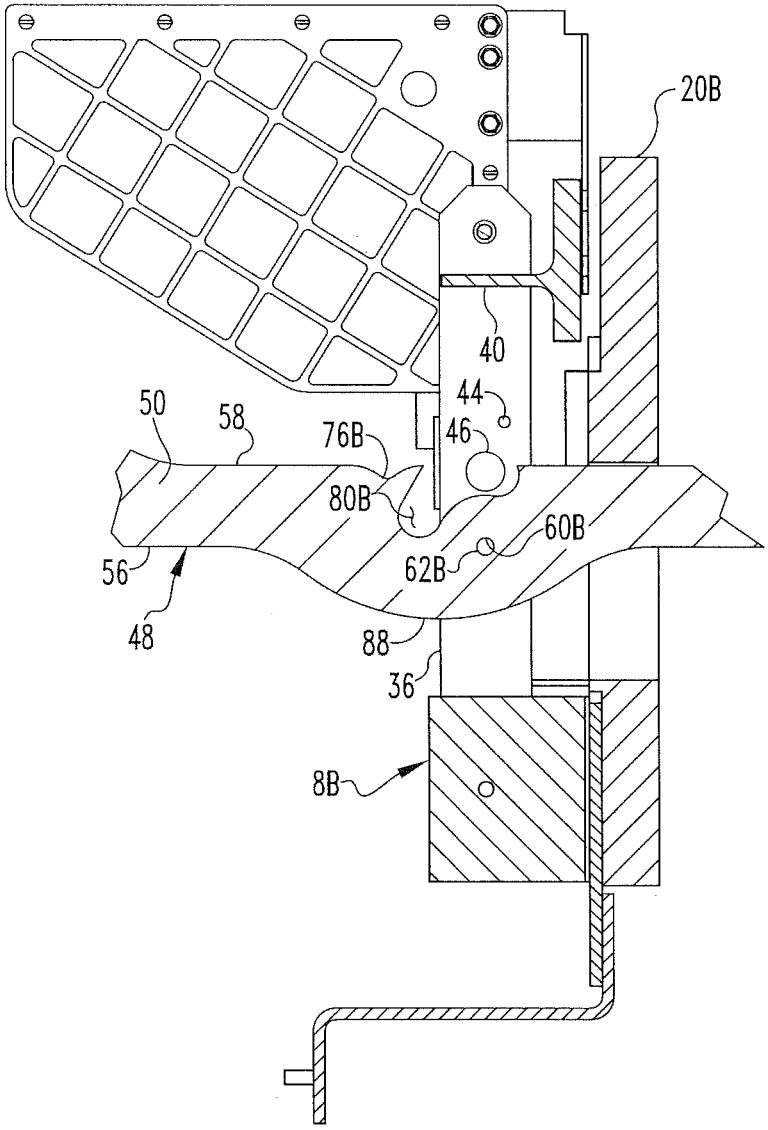
FIG. 5C is an enlarged view of the indicated portion of FIG. 5B.
Figure 6A:
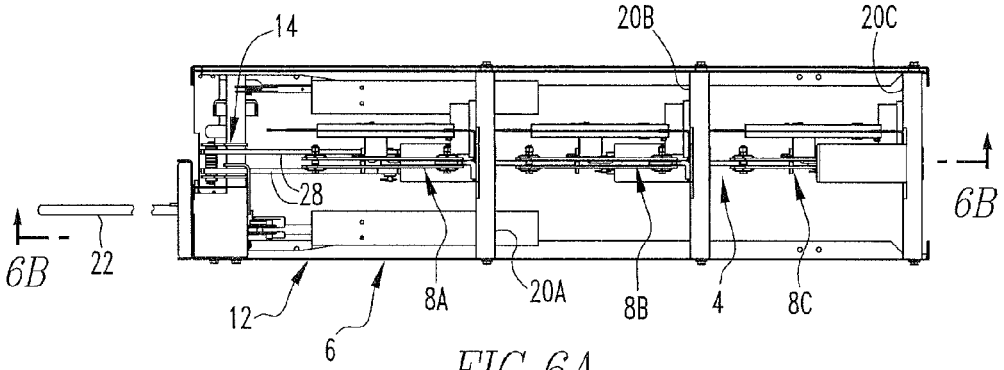
FIG. 6A is a top plan view of the switch apparatus in an OPEN position.
Figure 6B:
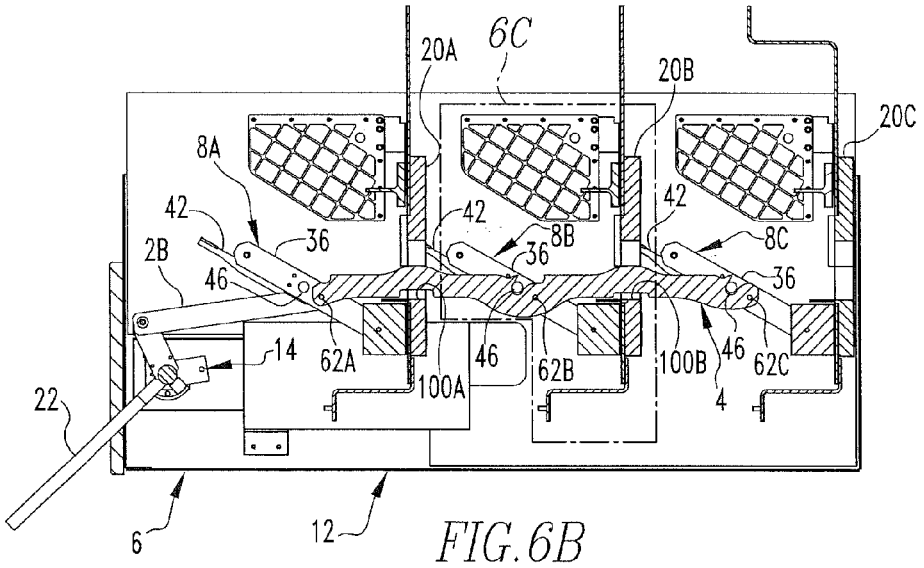
FIG. 6B is a sectional view as taken along line 6B-6B of FIG. 6A.
Figure 6C:
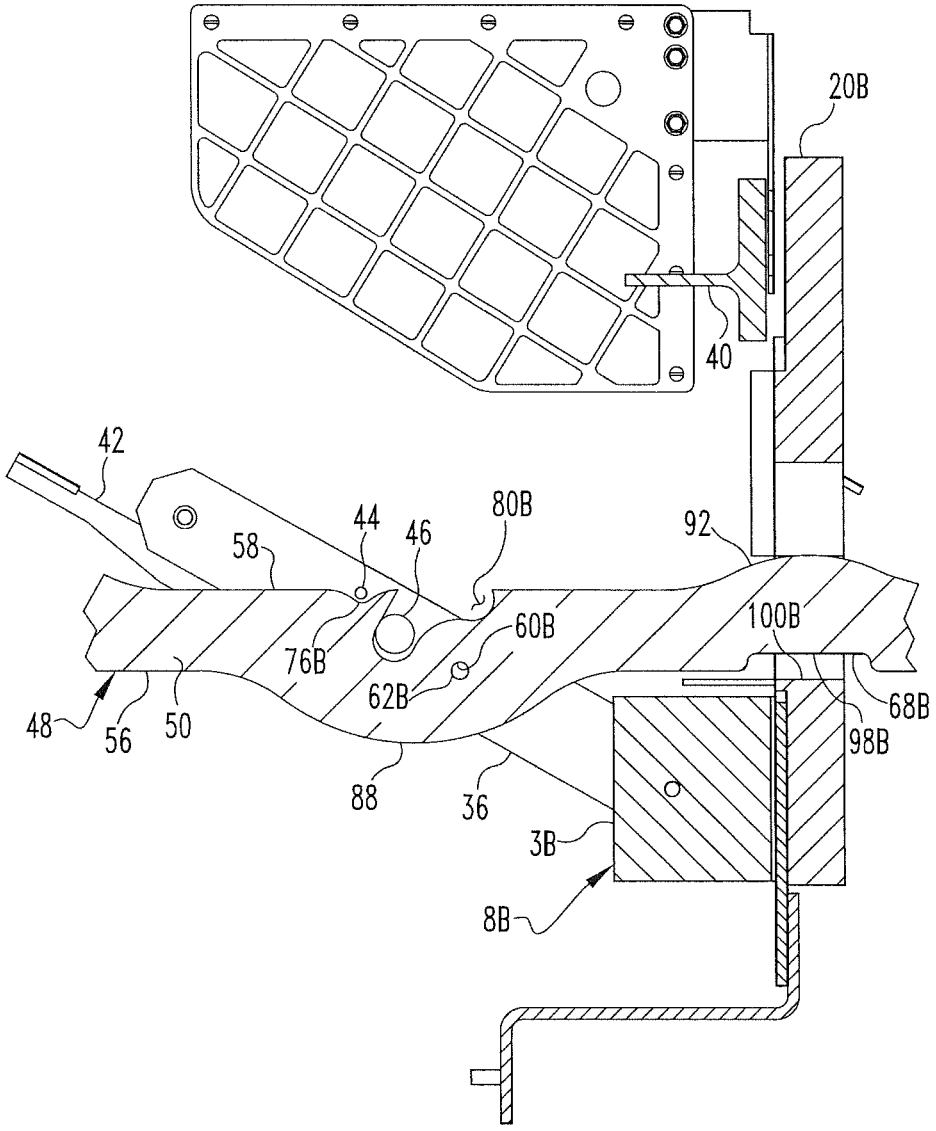
FIG. 6C is an enlarged view of the indicated portion of FIG. 6B.

The poles 8A, 8B, and 8C can be said to each include a conductive blade 36 that is pivotable between the CLOSED position of FIGS. 5A-5C and the OPEN position of FIGS. 6A-6C. An end of each blade 36 is pivotably connected in a well understood fashion with a first conductor 38 of its respective pole and is movable between one position electrically connected (FIGS. 5A-5C) with a second conductor 40 of the respective pole and another position electrically disconnected (FIGS. 6A-6C) therefrom.

The poles 8A, 8B, and 8C each further include a flicker element 42 that is pivotably mountable to the blade 36 with a flicker connector 44 (FIGS. 5C and 6C). As is generally understood, the flicker element 42 operates as a sacrificial conductor with respect to the second conductor 40, thereby saving the blade 36 of each pole from destruction due to arcing. The poles 8A, 8B, and 8C further each include a carriage bolt head 46 such as is depicted generally in FIGS. 5B-5C and FIGS. 6B-6C and which is a part of a carriage bolt that is usable to connect other structures with the blade 36.

The drive bar 4 can be understood from FIGS. 1A, 1B, 3, and 4 to include a linkage element 48 that is an elongated plate-like structure having a first face 50, a second face 52, a first edge 56, a second edge 58, and a plurality of holes 60A, 60B, and 60C that serve as connection points. The connection points 60A, 60B, and 60C are mechanically connectable with the poles 8A, 8B, and 8C, respectively, using a plurality of pins 62A, 62B, and 62C, respectively. The pins 62A, 62B, and 62C are receivable in the connection points 60A, 60B, and 60C and enable pivotable connection between the poles 8A, 8B, and 8C and the linkage element 48. The linkage element 48 advantageously mechanically connects the poles 8A, 8B, and 8C with one another.

The linkage element 48 advantageously includes a number of features that are indicated generally at the numeral 64 and which are structured to enable the linkage element 48 to avoid engagement with and interference with the various structures of the switch apparatus 6 while maintaining a sufficient mechanical strength to enable reliable mechanical connection among the poles 8A, 8B, and 8C. As employed herein, the expression "a number of" and variations thereof shall refer broadly to any non-zero quantity, including a quantity of one. As will be set forth in greater detail below, some of the features 64 can be generally described as being in the form of indentations that are formed in the linkage element 48. In general terms, the indentations are provided in order to enable the linkage element 48 to avoid various structures of the switch apparatus 6, and the indentations thus are generally situated in locations where the material of the linkage element 48 has been removed. Other features 64 can be generally described as being strengthening lugs that are provided generally in the vicinity of the aforementioned indentations, i.e., at the locations on the linkage element 48 where its material has been removed. The strengthening lugs serve to increase the strength of the linkage element 48 in the aforementioned locations from which the material of the linkage element 48 has been removed.

As can be understood from FIGS. 1A, 1B, 3, and 4, the features 64 can be said to include a pair of notches 60A and 60B, a pair of recesses 76B and 76C, and a set of three pockets 80A, 80B, and 80C. The features 64 further include a set of strengthening lugs that are indicated generally at the numerals 84, 86, 88, 92, and 96.

As can be understood from FIGS. 6B and 6C, the notches 68A and 68B are formed in the first edge 56 of the linkage element 48 and are of an approximately rectangular shape having planar base surfaces 98A and 98B, respectively. The notches 68A and 68B are configured to avoid engagement with and interference with the insulative supports 20A and 20B when the switch apparatus 6 is moved to its OPEN position and the linkage element 48 is situated in its second position. As can be seen in FIGS. 6B and 6C, the notches 68A and 68B are meaningfully spaced from a pair of internal surfaces 100A and 100B of the insulative supports 20A and 20B, respectively. Such meaningful spacing is provided since, as set forth above, the springs 32 can have the affect of moving the drive bar 4 and the switch apparatus 6 to the OPEN position with a significant amount of force which may have the tendency to cause the linkage element 48 or the various structures of the switch apparatus 6 to elastically deflect at the end of the typically range of movement. The notches 68A and 68B are meaningfully spaced from the internal surfaces 100A and 100B in the OPEN position of the switch apparatus 6 in order to avoid any interference or engagement between the drive bar 4 and any structures of the switch apparatus 6 even in the event of elastic deformation of any such structures upon reaching the OPEN position.

The recesses 76B and 76C are formed in the second edge 58 of the linkage element 48 and are each of a generally V-shaped configuration. The recesses 76B and 76C are configured, as can be seen in FIGS. 6B and 6C, to receive the flicker connector 44 of the poles 8B and 8C when the switch apparatus 6 is in its OPEN position and the drive bar 4 is in its second position. The recesses 76B and 76C are similarly meaningfully spaced from the flicker connectors 44 in the OPEN position of the switch apparatus 6 since, as mentioned above, the springs 32 can have a tendency to open the switch apparatus 6 with sufficient force to potentially elastically deflect the blades 36 or other structures of the switch apparatus 6. The recesses 76B and 76C thus advantageously avoid engagement with and interference between the linkage element 48 and the flicker connectors 44 of the poles 8B and 8C.

The pockets 80A, 80B, and 80C can each be said to include a perimeter 82A, 82B, and 82C, respectively, that is of an arcuate shape and that is configured to receive therein the carriage bolt head 46 of the respective poles 8A, 8B, and 8C. The pockets 80A and 80C, which are situated at the ends of the linkage element 48, are relatively smaller than the pocket 80B, which is situated generally in the center of the linkage element 48. That is, the pockets 80A and 80C have relatively less interaction with their corresponding carriage bolt heads 46 than the pocket 80B has with its corresponding carriage bolt head 46. The pockets 80A, 80B, and 80C are formed in the first face 50 and extend into the thickness of the linkage element 48 toward the second face 52 but less than the entirety of the distance to the second face 52. The pockets 80A, 80B, and 80C thus can generally be said to be formed in the first face 50 but not in the second face 52. It can also be seen that the pockets 80A, 80B, and 80C are each in communication with and situated adjacent the second edge 58 of the linkage element 48.

Figure 4:
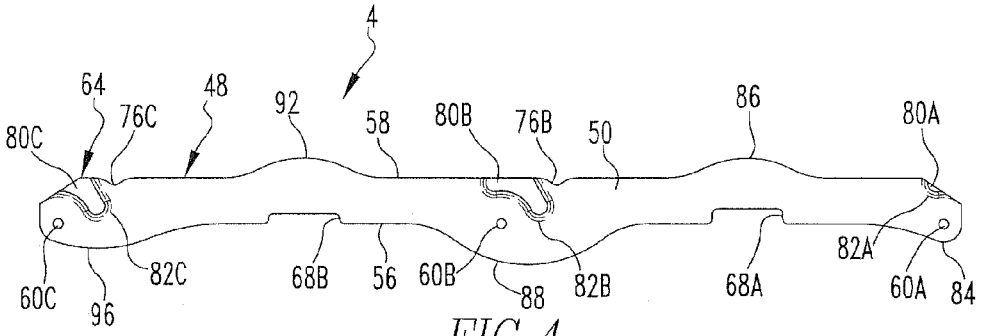
FIG. 4 is front elevational view of the drive bar of FIG. 1A.

As is best seen in FIG. 4, the strengthening lug 84 protrudes from the first edge 56 in situated generally the vicinity of the pocket 80A and the connection point 80A. The strengthening lug 86 can be said to be disposed generally in the vicinity of the notch 68A but protrudes outwardly from the second edge 58. The strengthening lug 88 can be said to be situated generally in the vicinity of the connection point 60B, the recess 76B, and the pocket 80B, and protrudes outwardly from the first edge 56. The strengthening lug 92 can be said to be situated generally in the vicinity of the notch 68B but protrudes outwardly from the second edge 58. The strengthening lug 96 can be said to be situated generally in the vicinity of the connection point 60C, the recess 76C, and the pocket 80C and protrudes outwardly from the linkage element 48 from the first edge 56 thereof.

As can be further understood from FIG. 4, the notches 68A and 68B can be said to be formed in the first edge 56 and can each be said to extend along a corresponding portion of the longitudinal extent of the linkage element 48. The strengthening lugs 86 and 92 are configured to protrude from the second edge 58 and to extend generally along the same portions of the longitudinal extent of the linkage element 48 along which the notches 68A and 68B, respectively, extend. Since the notches 68A and 68B are formed via a removal of material from the plate that forms the linkage element 48, the strengthening lugs 86 and 92 are provided on an opposite edge, i.e., the second edge 58, in order to increase the amount of material of the linkage element 48 in order to provide sufficient strength to the linkage element 48 to ensure reliable operation of the switch apparatus 6 between its CLOSED and OPEN positions. As can be seen in FIG. 4, the notches 68A and 68B are of different depths that are suited to the structures within the switch apparatus 6, and the lengths of the notch 68A and 68B along the longitudinal direction are substantially greater than their depths.

Likewise, the strengthening lug 84 is provided in order to increase the strength of the linkage element 48 generally in the vicinity of the connection point 80A and the pocket 80A, both of which constitute regions from which the material of the plate that forms the linkage element 48 has been removed. The strengthening lug 84 protrudes from the first edge 56 of the linkage element 48, which is opposite the edge, i.e., the second edge 58, at which the pocket 80A is formed. Likewise, the strengthening lug 88 is provided in order to increase the strength of the linkage element 48 in the vicinity of the connection point 60B, the recess 60B, and the pocket 80B, all of which constitute regions from which the material of the plate that forms the linkage element 48 has been removed. Likewise, the strengthening lug 96 increases the strength of the linkage element 48 and overcomes the formation of the connection point 60C and the pocket 80C, both of which resulted from removal of material from the plate that forms the linkage element 48.

It thus can be seen that the various features 64 of the linkage element 48 enable the drive bar 4 to avoid interference with and engagement between the linkage element 48 and the various structures of the switch apparatus 6. Certain of the features 64, i.e., the strengthening lugs 84, 86, 88, 92, and 96, add material and strength in the vicinity of the connection points 60A, 60B, 60C, the notches 68A and 68B, and the recesses 76B and 76C in order to provide the linkage element 48 with sufficient strength to reliably move the poles 8A, 8B, and 8C of the switch apparatus 6 between the CLOSED and OPEN positions. Variations of the same will be apparent.

As can be understood from the figures, the primary movement of the drive bar 4 between the first position of FIGS. 5A-5C and the second position of FIGS. 6A-6C amounts generally to translation of the drive bar 4 in a direction parallel with its longitudinal extent and translation of the drive bar 4 in a direction generally perpendicular to its longitudinal extent. The drive bar 4 thus is generally not pivoted or rotated to any meaningful extent, which advantageously enables the poles 8A, 8B, and 8C to be arranged one behind the other. This, in turn, enables the switch apparatus 6 to be configured with a relatively narrow side-to-side profile which advantageously occupies less accessible floor space than previously known devices.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A drive bar structured to extend among a plurality of poles of a switch apparatus, each pole having a conductive blade that is pivotable between a CLOSED position and an OPEN position, the drive bar being structured to enable the plurality of poles to be together moved between the CLOSED and OPEN positions, the drive bar comprising:

an elongated linkage element having a plurality of connection points that are spaced apart from one another along at least a portion of the length of the linkage element, each connection point being structured to be connected with a corresponding pole of the plurality of poles;

the linkage element having formed therein a number of features, at least some of the number of features being structured to enable the linkage element to avoid engagement with a number of structures of the switch apparatus, the number of features comprising at least a first indentation formed in the linkage element;

wherein the at least first indentation comprises at least a first recess that is formed in an elongated first edge of the linkage element and that is structured to avoid engagement between the linkage element and a structure situated on the conductive blade of a pole of the plurality of poles; and wherein the at least first indentation further comprises at least a first notch that is formed in an elongated second edge of the linkage element and that is structured to avoid engagement with a support element upon which at least a portion of the pole is mounted, and wherein the second edge of the linkage element is situated opposite the first edge.

2. The drive bar of claim 1 wherein the at least first notch extends along a first portion of the longitudinal extent of the linkage element, and wherein the at least first recess is formed in the first edge at a location spaced from the first portion of the longitudinal extent of the linkage element.

3. The drive bar of claim 2 wherein the number of features further comprise a strengthening lug that protrudes from the first edge and that extends generally along the first portion of the longitudinal extent of the linkage element.

4. The drive bar of claim 2 wherein a connection point of the plurality of connection points is structured to enable the linkage element to be connected with the pole, and wherein the connection point is situated at a location along the longitudinal extent of the linkage element that is disposed generally between the at least first recess and the at least first notch.

5. The drive bar of claim 1 wherein the plurality of connection points comprise a primary connection point that is structured to be connected with a pole of the plurality of poles and that is structured to be further connected with an operating mechanism of the switch apparatus which is structured to move the drive bar between a first position that corresponds with the CLOSED position of the plurality of poles and a second position that corresponds with the OPEN position of the plurality of poles.

6. The drive bar of claim 1 wherein at least one connection point of the plurality of connection points comprise a hole that is formed in the linkage element and that is structured to receive a connection element therein.

7. A switch apparatus comprising the drive bar of claim 1, the switch apparatus further comprising a plurality of poles, each pole having a conductive blade that is pivotable between a CLOSED position and an OPEN position, the drive bar being connected with each pole of the plurality of poles and being structured to enable the conductive blades of the plurality of poles to be together moved between the CLOSED and OPEN positions.

8. A drive bar structured to extend among a plurality of poles of a switch apparatus, each pole having a conductive blade that is pivotable between a CLOSED position and an OPEN position, the drive bar being structured to enable the plurality of poles to be together moved between the CLOSED and OPEN positions, the drive bar comprising:

an elongated linkage element having a plurality of connection points that are spaced apart from one another along at least a portion of the length of the linkage element, each connection point being structured to be connected with a corresponding pole of the plurality of poles;

the linkage element having formed therein a number of features, at least some of the number of features being structured to enable the linkage element to avoid engagement with a number of structures of the switch apparatus, the number of features comprising at least a first indentation formed in the linkage element; and wherein the linkage element is of an elongated plate-like configuration having a first face and a second face opposite one another, and wherein the at least first indentation comprises at least a first pocket formed in the first face adjacent an elongated edge of the linkage element, the at least first pocket extending into the linkage element from the first face less than fully the distance to the second face.

9. The drive bar of claim 8 wherein the at least first pocket has an arcuate perimeter that extends along the first face, and wherein the at least first pocket is structured to resist engagement between the linkage element and a structure situated on the conductive blade of a pole of the plurality of poles.

10. The drive bar of claim 8 wherein the at least first indentation further comprises at least a first recess that is formed in the elongated edge of the linkage element and that is structured to avoid engagement between the linkage element and a structure situated on the conductive blade of a pole of the plurality of poles.

11. The drive bar of claim 10 wherein the at least first recess is generally V-shaped.

12. The drive bar of claim 8 wherein the elongated edge is an elongated second edge, wherein the at least first indentation further comprises at least a first notch that is formed in an elongated first edge of the linkage element opposite the second edge and that extends along a first portion of the longitudinal extent of the linkage element, and wherein the number of features further comprise a strengthening lug that protrudes from the second edge of the linkage element and that extends generally along the first portion of the longitudinal extent of the linkage element.

13. The drive bar of claim 12 wherein the at least first notch includes a generally planar surface that is formed on the linkage element and that is structured to avoid engagement with a support element upon which at least a portion of a pole of the plurality of poles is mounted.

14. The drive bar of claim 12 wherein the at least first notch has a length along the first portion of the longitudinal extent of the linkage element and a depth that is transverse to the length, the length being substantially greater than the depth.

15. A switch apparatus comprising the drive bar of claim 8, the switch apparatus further comprising a plurality of poles, each pole having a conductive blade that is pivotable between a CLOSED position and an OPEN position, the drive bar being connected with each pole of the plurality of poles and being structured to enable the conductive blades of the plurality of poles to be together moved between the CLOSED and OPEN positions.

* * * * *